United States Patent [19]

Brunhoefer

[11] Patent Number: 4,986,573

[45] Date of Patent: Jan. 22, 1991

[54] LAYOUT SHEET

[76] Inventor: Harry C. Brunhoefer, 5842 Banning Pl., Burke, Va. 22015

[21] Appl. No.: 520,504

[22] Filed: May 8, 1990

[51] Int. Cl.[5] ..... B42D 15/00

[52] U.S. Cl. ..... 283/62; 283/115; 283/117; 283/900; 40/594; 40/595

[58] Field of Search ..... 283/62, 900, 117, 115; 40/594, 595; 355/61, 125, 133

[56] References Cited

U.S. PATENT DOCUMENTS

| | | | |
|---|---|---|---|
| 1,788,421 | 1/1931 | Cooper | 283/117 |
| 2,775,048 | 12/1956 | Berman | 40/595 |
| 2,914,873 | 12/1959 | Berman | 40/594 |
| 3,202,071 | 8/1965 | Carlson | 355/125 |
| 3,440,746 | 4/1969 | Richards | 40/595 |
| 3,503,835 | 3/1970 | Hermann | 40/594 |
| 3,761,344 | 9/1973 | Mrozek et al. | 40/595 |
| 4,334,771 | 6/1982 | Ryan, Jr. | 283/117 |

*Primary Examiner*—Frank T. Yost
*Assistant Examiner*—Hwei-Siu Payer
*Attorney, Agent, or Firm*—Dennis H. Lambert

[57] ABSTRACT

A sheet used for laying out or composing lines of text, art work and the like for subsequent photographic reproduction in the printing and graphic arts industries, in which the sheet has non-photographically reproducible indicia on one side or face thereof to facilitate aligning and positioning of the text and the like, and wherein a dry, transparent, tacky adhesive coating is applied to the face for securely holding the text and the like in place, and which also enables the text and the like to be removed and repositioned plural times.

9 Claims, 2 Drawing Sheets

LAYOUT SHEET

FIELD OF THE INVENTION

This invention relates to the graphic arts and printing industries. More specifically, the present invention relates to an adhesively coated paper for use in composing or laying out written material, art work and the like for subsequent printing in newspapers, magazines and other media.

DESCRIPTION OF THE PRIOR ART

In the print media and graphic arts industries, the selection and arrangement of material to be printed in newspapers, magazines, advertising literature, and the like, is typically manually performed by skilled artisans working in paste-up or composing rooms. The selection and arrangement of such material includes the organization and spacing of lines of text, art work and the like, and the choice of different fonts, colors, etc., to achieve the most optically pleasing effect. Once the artisan has achieved the desired effect, the appropriately composed material is photographed in cameras designed for the purpose, and subsequently printed or otherwise processed, as desired.

In composing print, such as text, art work, and the like for subsequent photographing and printing, sheets of paper with non-photographically reproducible grid lines or other indicia thereon are used as an aid for accurately aligning and positioning the text material, art work, and the like. The print is held in place on the sheets of paper by use of adhesives, double face tape, or wax, so that the material thus composed can be photographed.

The sheets of paper used in this process are commonly referred to as layout sheets, grids, flats or the like, depending upon the style and weight of the paper, and as used hereinafter, the term "sheet" is intended to cover or refer to any or all of the various forms used in the industry. For instance, layout sheets are generally lighter weight flexible sheets or rolls of grid-lined paper that might be used, for example, to compose a sheet of newspaper print that is intended to run only once. Flats, on the other hand, are heavier weight or stiffer paper that might be used, for example, to compose an advertisement or the like intended to run more than once, and which must therefore be saved for subsequent re-use. Whatever the style of paper used, suitable indicia is provided on its face for assisting in aligning and positioning the text or the like to be printed. This indicia typically comprises grid lines in nonphotographically reproducible blue or lavender color, although any suitable indicia and color may be used.

The most common technique employed in the industry to hold the text, art work or the like in place is to apply a specially formulated wax to sheets of letters, characters, lines of text, art work, and other indicia which are then cut out and applied to the indexed layout sheet, flat or grid. In practicing this technique, cakes, sticks or other forms of wax in solid state are placed in wax machines, which apply heat to melt the wax and maintain it in a liquid state. The material to be waxed is then passed through the machine, whereupon a thin layer of the melted wax is applied to the material. This wax layer presents a tacky surface which will cause the letters, characters, lines of text, etc., to adhere to the layout sheet, flat or other work surface being used to compose the information to be subsequently printed.

The tacky wax surface enables the artisan to remove and replace the letters, text, etc., whereby different arrangements may be tried until the most visually pleasing effect is achieved. However, the characters, text, etc., may typically be placed on the layout sheet and removed only two or three times before the wax layer loses its tackiness or deteriorates to the point that the characters and the like will no longer stick to the surface.

There are numerous other disadvantages associated with use of the wax method. For instance, composing or paste-up rooms must utilize at least one wax machine, and typically more than one, which must be plugged into an electrical outlet. In addition, supplies of wax to be melted in the machines must be maintained, and the level of wax in the machines must be monitored and replenished during the course of a day. Moreover, these machines must be periodically cleaned and serviced, and the heated wax emits a noxious odor. Further, personnel working in the composing room must occasionally wait to use a wax machine while another person is using it, resulting in lost production time and increased cost.

The wax layer applied to the paper also tends to lose its tackiness over a relatively short period of time, making it difficult, if not impossible, to archive previously composed materials. Waxed layout sheets typically may be stored only about sixty days before they lose their tackiness and/or the wax begins deteriorating. Further, the wax layer tends to bubble and/or burn when subjected to the heat of lights in the cameras used during the photographic step, imparting imperfections to the work.

For some uses, pre-press composing of text material, graphics and the like may also be accomplished on computers. However, even when computers are used for composing, the final, camera ready copy must be prepared in paste-up or composing rooms using wax or other adhesives when large items, such as newspapers, are to be printed.

Spray-on or brush-on adhesives and double face tape may also be used to apply characters, letters, etc., to layout sheets, but these methods generally do not permit placement, removal and replacement of the characters, etc. during the composing process. Accordingly, if a mistake is made, or if the desired result is not achieved after the first effort at composing the material, the initial sheet must be discarded and the effort started over.

In the making of signs or when applying lettering, etc., to windows, sides of vehicles and the like, transfer sheets are sometimes used. These sheets incorporate an adhesively coated surface on which the material to be transferred is placed. The transfer sheet with the letters, etc., adhered thereto is then placed on or against the surface to which the letters, etc., are to be transferred, and a burnishing tool or other implement is used to firmly press the letters, etc., onto the final surface, whereupon the transfer sheet may be peeled away, leaving the letters, etc., in place. Examples of some such prior art techniques are disclosed in the following U.S. Pat. Nos.: 1,124,531, 2,970,043, 3,013,917, 3,137,605, 3,676,248, 3,945,141, 4,520,062 and 4,600,460.

SUMMARY OF THE INVENTION

Accordingly, it is an object of the present invention to provide a layout sheet, grid, flat, or the like, for use in composing or arranging material to be printed, in which the need for wax, double face tape, spray-on adhesive and the like is eliminated.

Another object of the invention is to provide an adhesively coated layout sheet, flat, grid, or the like for use in composing material to be printed, wherein the adhesive enables release and repositioning of text and the like on the sheet.

A further object of the invention is to provide a layout sheet, flat, grid, or the like which has a thin coating of tacky material on one face that enables text or other material to be positioned on the sheet and released for repositioning, as desired.

A still further object of the invention is to provide a layout sheet, flat, grid, or the like that has a thin layer or coating of a rubber based or acrylic adhesive on one face thereof, in which text or the like may be placed on the coated face and held in position for photographing or other processing, and in which the text or the like may be released and repositioned, as desired.

Yet another object of the invention is to provide a layout sheet, flat, grid, or the like for use in arranging or composing text and other material to be printed, in which a tacky adhesive coating is applied to one face of the sheet for holding text and the like positioned thereon, and wherein the sheets with text and the like applied may be stored for prolonged periods of time without losing their tackiness.

Another object of the invention is to provide a layout sheet, grid, flat, or the like which has a dry, releasable adhesive coating that will not bubble or otherwise deteriorate under the heat of lights used in photographic cameras during the composing and printing process.

A still further object of the invention is to provide a tacky surface on layout sheets, grids, flats, or the like, which is simple and economical and which eliminates the messiness and noxious odor of melted wax coatings traditionally employed.

BRIEF DESCRIPTION OF THE DRAWINGS

The foregoing and other objects and advantages of the invention will become apparent from the following detailed description and claims when considered in conjunction with the accompanying drawings, in which like reference characters designate like parts throughout the several views, and wherein:

DETAILED DESCRIPTION OF THE PREFERRED EMBODIMENTS

Figure 1:
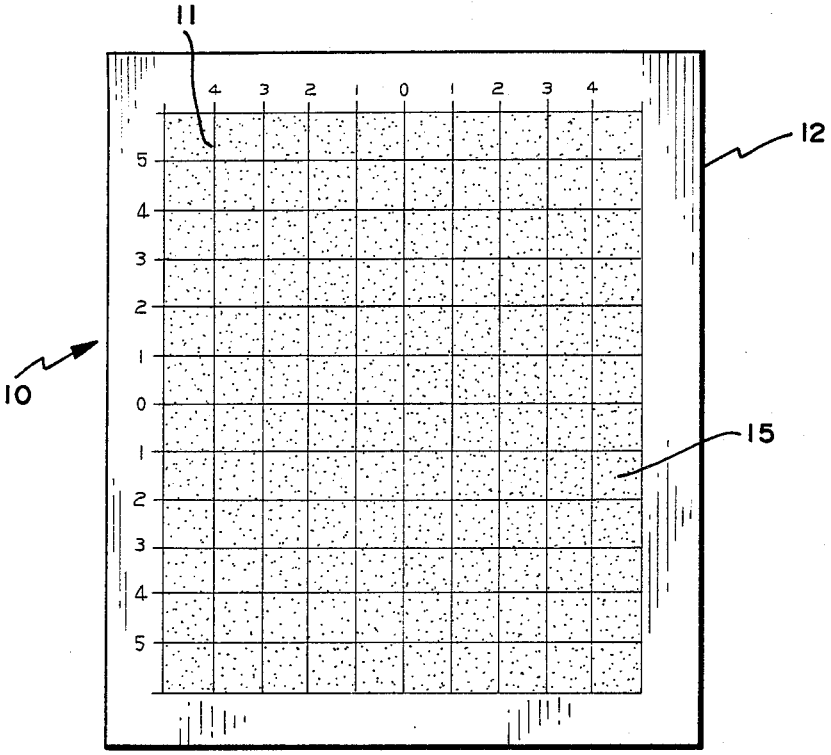
FIG. 1 is a top plan view of a laYout sheet, flat, or grid having a layer of adhesive on its face in accordance with the invention.
Figure 2:
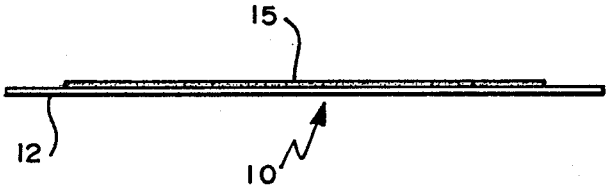
FIG. 2 is a greatly enlarged, schematic transverse sectional view of a layout sheet, flat or grid in accordance with the invention, showing the layer of adhesive on the printed face.
Figure 3:
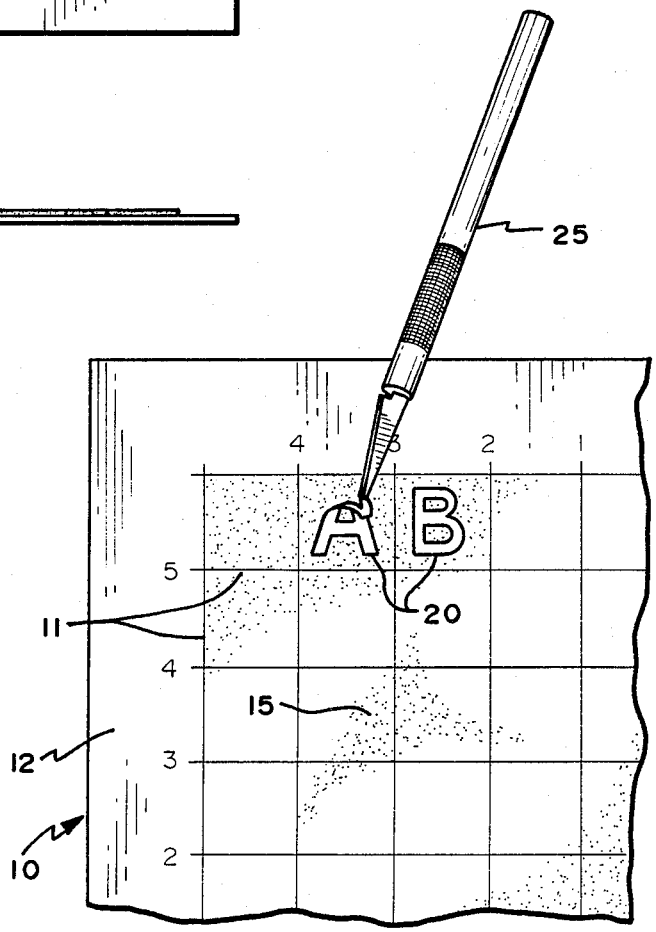
FIG. 3 is a somewhat diagrammatic top plan view of a layout sheet, flat or grid in accordance with the invention, showing how a previously applied letter, etc., may be removed for repositioning.

Referring more particularly to the drawings, a layout sheet, flat, grid or the like is indicated generally at 10 in FIG. 1–3. The sheet 12 preferably is made of paper of conventional weight and composition, and has suitable non-photographically reproducible indicia 11 on its face. As shown in this form of the invention, the indicia comprises grid lines dividing the surface of the sheet into uniform squares or areas, and typically is in blue or lavender ink. Other non-photographically reproducible colors may be used, of course, and other indicia may also be used instead of the grid lines shown.

In accordance with the invention, a thin layer or coating of a suitable commercially available rubber- or acrylic-based dry, tacky, transparent adhesive 15 is applied to the printed face of the paper. The adhesive may be applied in any suitable way, such as, for example, spraying, rolling, etc., and may comprise any adhesive substance which remains tacky and which permits repeated application and release of letters or other indicia 20. An example of a suitable adhesive substance is that used by 3M Company in its "Highland" and "Post-it" self-sticking note pads.

Text material, characters, art work and/or other indicia 20 are obtained in the conventional way and positioned on the sheet 10 by the artisan composing information to be printed. The adhesive securely holds the placed indicia in position for photographic reproduction, yet permits the indicia to be easily removed with a suitable tool, shown here as an "Exacto" knife 25, for example, for repositioning as desired.

The adhesive is not messy, does not require wax machines or wax supplies, does not produce a noxious odor, does not require the artisan to take valuable time to produce a tacky surface on the sheet, and remains tacky for an indefinite time, thereby enabling the composed material to be archived.

The degree of tackiness of the adhesive coating may be selected as desired during the manufacturing process, although a medium tacky surface is preferred. Less aggressive tacky surfaces may not hold the positioned characters and the like securely enough, and more aggressive tacky surfaces may not release them for repositioning.

Figure 4:
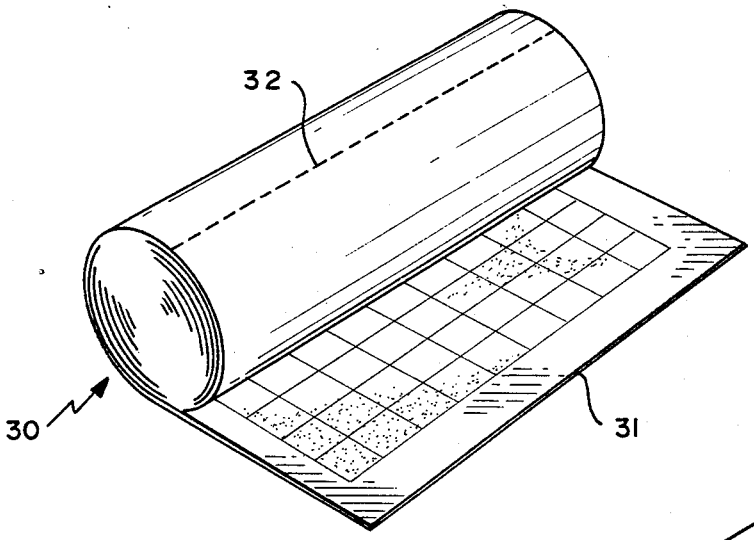
FIG. 4 is a perspective view of one form of the invention wherein the layout sheets or the like are supplied in a roll.

The sheets, flats or grids may be provided in individual sheets as illustrated in FIGS. 1–3, or they may be provided in rolls 30 (FIG. 4). Individual sheets 31 may be separated from other sheets in the roll 30 along perforated tear lines 32, if desired.

Figure 5:
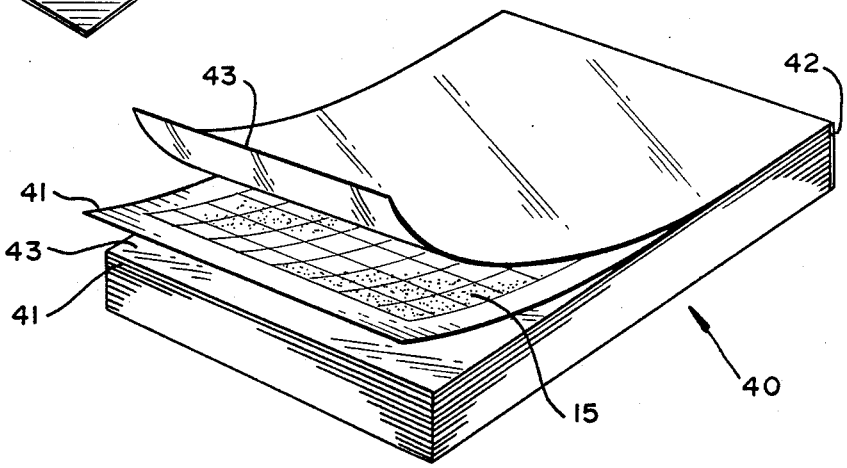
FIG. 5 is a perspective view of another form of the invention, wherein the layout sheets or flats or the like are supplied in pad form with separator sheets therebetween.
Figure 6:
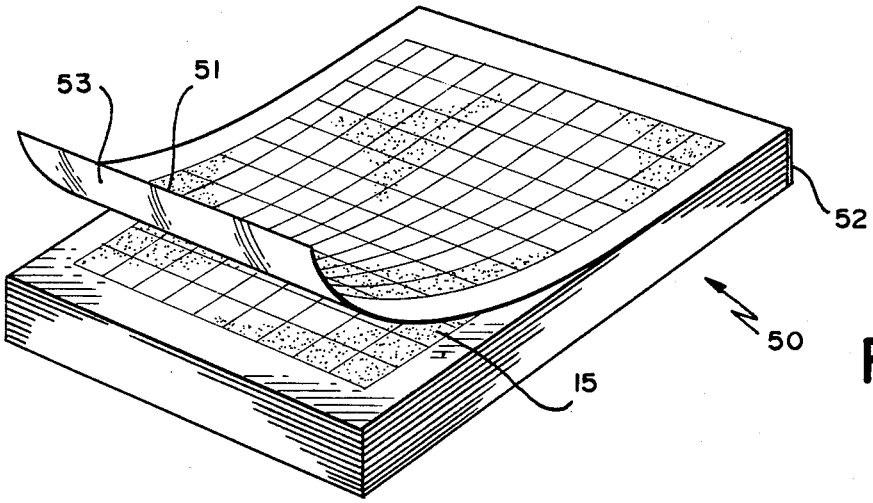
FIG. 6 is a perspective of yet another form of the invention, wherein the backs of adjacent sheets are treated with a release agent.

Alternatively, the sheets may be provided in pads 40 (FIG. 5). In this arrangement, the sheets 41 could be secured together at one edge along a spine 42 in any suitable manner, and individual sheets could be separated from one another by a thin, transparent or semi-transparent overlay 43 placed between adjacent sheets.

In another form of the invention, individual sheets 51 are provided in pads 50, and are secured together at a spine 52 in any suitable conventional way. In this form of the invention, the backs of the individual sheets are treated with a suitable material 53, such as silicone, which acts as a release agent to facilitate release of one sheet from a subadjacent sheet.

Sheets made in accordance with the invention may be provided in any desired size, ranging from about seven inches in width up to about fifty inches in width, for example, and they may have any suitable stiffness or composition for the intended purpose, including conventional dimensions and materials as presently used in the industry. In addition to the specific configurations described and illustrated herein, the invention may also be applied to overlay sheets for color separation.

Although the invention has been described with reference to particular embodiments, it is to be understood that these embodiments are merely illustrative of the application of the principles of the invention. Numerous modifications may be made therein and other arrangements may be devised without departing from the spirit and scope of the invention.

I claim:

1. A sheet used for laying out or composing lines of text, art work for subsequent photographic reproduction in the printing and graphic arts industries, in which the sheet has non-photographically reproducible indicia on one side or face thereof to facilitate aligning and positioning of the text, and wherein a dry, transparent, tacky adhesive coating is applied to said one face for securely holding the text in place, and which also enables the text to be removed and repositioned plural times.

2. A sheet as claimed in claim 1, wherein:

the sheet comprises a layout sheet of lightweight, flexible paper having non-photographically reproducible grid lines on its face.

3. A sheet as claimed in claim 1, wherein:

the sheet comprises a flat of cardboard-like material having non-photographically reproducible grid lines on its face.

4. A sheet as claimed in claim 1, wherein:

the sheet is provided in a roll of sheets attached along frangible tear lines.

5. A sheet as claimed in claim 1, wherein:

the sheet is provided in a paid of sheets joined at one edge via a spine.

6. A sheet as claimed in claim 5, wherein:

individual sheets in the pad of sheets are separated from one another by a separator sheet interposed between adjacent sheets and which does not adhere to the adhesive coating on the sheets.

7. A sheet as claimed in claim 5, wherein:

each sheet has a release coating such as silicone on the side opposite its face, to prevent adherence of one sheet to the adhesively coated face of a subadjacent sheet.

8. A sheet as claimed in claim 1, wherein:

the adhesive comprises a rubber-based adhesive.

9. A sheet as claimed in claim 1, wherein:

the adhesive comprises an acrylic-based adhesive.

* * * * *